US007238049B1

(12) United States Patent
Wu

(10) Patent No.: US 7,238,049 B1
(45) Date of Patent: Jul. 3, 2007

(54) ELECTRONIC DEVICE INTERCONNECTION SYSTEM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/510,160

(22) Filed: Aug. 25, 2006

(51) Int. Cl.
*H01R 13/648* (2006.01)

(52) U.S. Cl. ..... 439/607; 439/374

(58) Field of Classification Search ..... 439/352, 439/607, 374
See application file for complete search history.

(56) References Cited

U.S. PATENT DOCUMENTS 5,280,191 A * 1/1994 Chang ..... 257/712
5,425,657 A 6/1995 Davis et al.
5,564,939 A 10/1996 Maitani et al.
5,797,771 A 8/1998 Garside
6,095,862 A 8/2000 Doye et al.
6,135,793 A * 10/2000 Babineau ..... 439/92
6,165,006 A 12/2000 Yeh et al.
6,648,665 B1 11/2003 Wu
6,659,790 B1 12/2003 Wu
6,749,458 B1 6/2004 Kuo et al.
6,764,342 B2 7/2004 Murayama et al.
6,866,533 B2 3/2005 Wu
6,887,091 B1 5/2005 Wu
6,887,101 B2 5/2005 Ito et al.
7,090,509 B1 * 8/2006 Gilliland et al. ..... 439/76.1
7,114,980 B1 * 10/2006 Wu ..... 439/352
7,134,914 B1 * 11/2006 Wu ..... 439/610
7,147,501 B1 * 12/2006 Wu ..... 439/352
7,147,502 B1 * 12/2006 Wu ..... 439/352
7,160,135 B1 * 1/2007 Wu ..... 439/352
2005/0181670 A1 * 8/2005 Kumamoto et al. ..... 439/607
2005/0245132 A1 * 11/2005 Huang et al. ..... 439/607
2006/0019525 A1 1/2006 Lloyd et al.
2006/0040556 A1 2/2006 Neer et al.
2006/0160399 A1 * 7/2006 Dawiedczyk et al. ..... 439/374
2006/0228946 A1 * 10/2006 Chung ..... 439/607

OTHER PUBLICATIONS

"SFF-8088 Specification for Compact Multilane shielded connector" published on Mar. 11, 2005 by SFF Committee.

* cited by examiner

*Primary Examiner*—Michael C. Zarroli
*Assistant Examiner*—Phuongchi Nguyen
(74) *Attorney, Agent, or Firm*—Wei Te Chung

(57) ABSTRACT

An electronic device interconnection system includes a plug connector (200) and a receptacle connector (100) mating with the plug connector. The plug connector includes a metal housing (1') defining a roomage, a printed circuit board (2') received in the roomage, at least one cable (7') electrically connecting with the printed circuit board, a latch mechanism (3') includes a latch member (31') assembled to the metal housing. The receptacle connector (100) comprises an insulated housing (1) defining a receiving passage, a plurality of terminals (2) received in the insulated housing, a metal shell (3) for receiving the insulated housing and the metal shell defining a loop-guiding portion (304) with a chamfer (31) and a planar-guiding portion (303) for mating the plug connector easily and correctly.

18 Claims, 13 Drawing Sheets

ELECTRONIC DEVICE INTERCONNECTION SYSTEM

CROSS-REFERENCE TO RELATED APPLICATIONS

This application is related to U.S. patent application Ser. No. 7,114,980 filed on Aug. 11, 2005 and entitled "CABLE CONNECTOR ASSEMBLY WITH LATCHING MECHANISM", U.S. patent application Ser. No. 7,134,914 filed on Aug. 11, 2005 and entitled "CABLE CONNECTOR ASSEMBLY WITH LATCHING MECHANISM", U.S. patent application Ser. No. 7,147,502 filed on Nov. 8, 2005 and entitled "CABLE CONNECTOR ASSEMBLY WITH LATCHING MECHANISM", U.S. patent application Ser. No. 7,147,501 filed on Nov. 8, 2005 and entitled "JUXTAPOSED CABLE CONNECTOR ASSEMBLIES", and U.S. patent application Ser. No. 7,160,035 filed on Dec. 30, 2005 and entitled "STACKED CONNECTOR ASSEMBLY", U.S. patent application Ser. No. 11/213,048 filed on Aug. 26, 2005 and entitled "CABLE CONNECTOR ASSEMBLY WITH EMI GASKET", and U.S. patent application Ser. No. 11/481,132 filed on Jul. 3, 2006 and entitled "CABLE CONNECTOR ASSEMBLY WITH LATCHING MECHANISM", all of which have the same applicant and assignee as the present invention. The disclosure of these related applications is incorporated herein by reference.

BACKGROUND OF THE INVENTION

1. Field of the Invention

The present invention generally relates to an electronic device interconnection system, and more particularly to a plug connector mating with a receptacle connector easily and reliably.

2. Description of Related Art

In recent years, low profile connectors, such as those used in SFP (Small Form Factor Pluggable) and SFP-like applications are desired in electronic devices in which space is a premium. U.S. Pub. No. 2006/0019525 A1 discloses a plug connector for engaging with a receptacle connector arranged on a circuit board. The receptacle connector has a metal shell encompasses an insulated housing and the metal shell defines an entrance through which the plug connector may be inserted. However, as smaller the spaces and sizes of the entrance are, it is difficult to ensure that the plug connector can mate with the receptacle connector easily and correctly.

Hence, an improved electronic interconnection system are provided in the present invention to address the problems mentioned above and meet the current trend.

BRIEF SUMMARY OF THE INVENTION

Accordingly, an object of the present invention is to provide an electronic device interconnection system comprising a plug connector and a receptacle connector, and the plug connector mates with the receptacle connector easily and reliably.

In order to achieve the above-mentioned object, an electronic device interconnection system comprises a plug connector and a receptacle connector mating with the plug connector. The plug connector comprises a metal housing defining a roomage, a printed circuit board received in the hollow, at least one cable electrically connecting with the printed circuit board, a latch mechanism comprising a latch member assembled to the metal housing. The latch member comprises an engaging portion engaging with the metal housing and a latch portion extending forwardly from the engaging portion. A receptacle connector mating with the plug connector comprises an insulated housing defining a receiving passage, a plurality terminals received in the insulated housing and a metal shell defining a body portion with a hollow to receive the insulated housing. The body portion defines at least one latch hole in front portion thereof to receive the latch portion of the latch member. The body portion further defines a planar-guiding portion extending into the hollow and located above the insulated housing for suppressing rotation of the plug connector and guiding the plug connector inserting into the receptacle connector.

Other objects, advantages and novel features of the invention will become more apparent from the following detailed description of the present embodiment when taken in conjunction with the accompanying drawings.

DETAILED DESCRIPTION OF THE INVENTION

Figure 1:
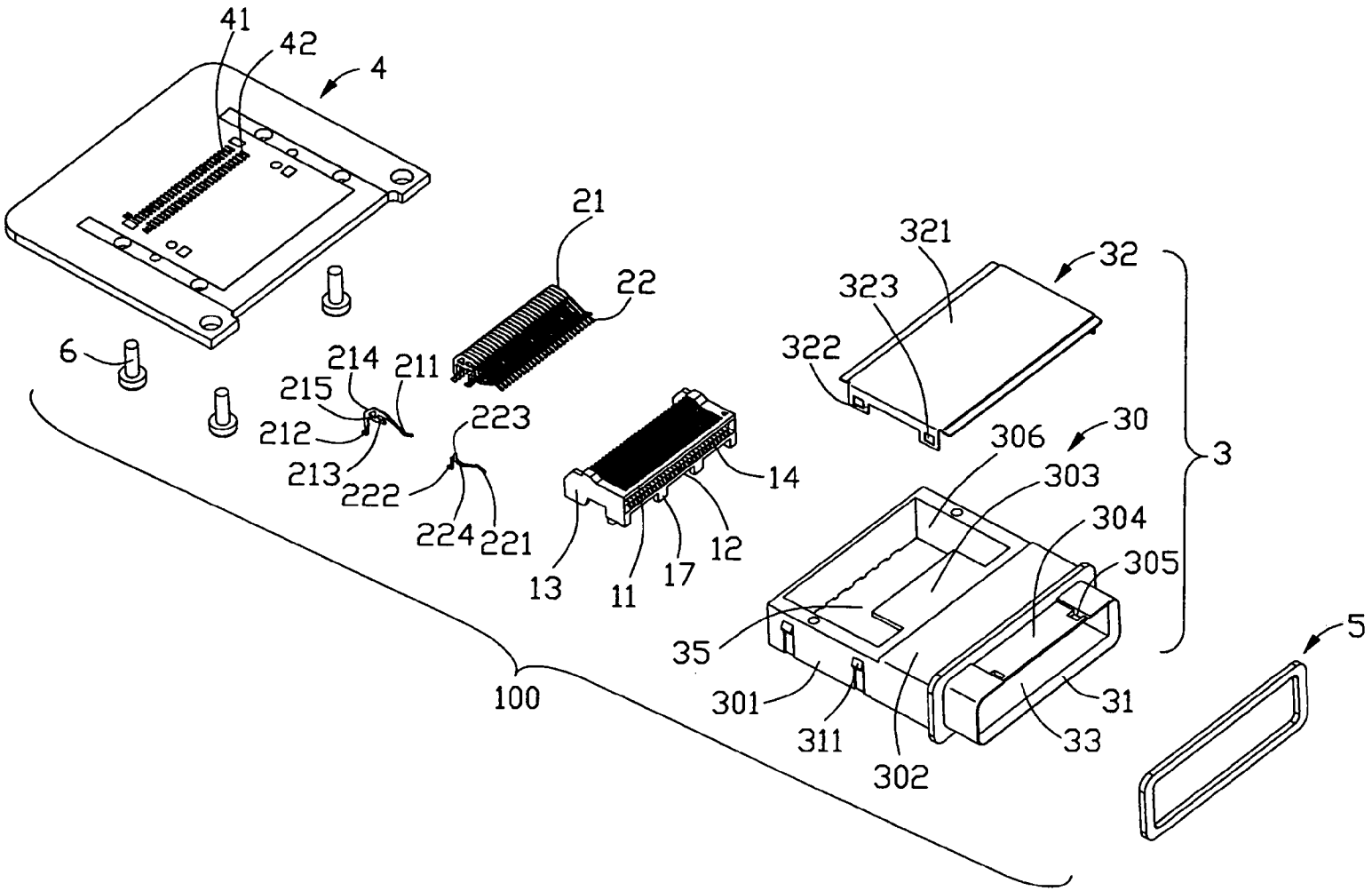
FIG. 1 is an exploded, perspective view of a receptacle connector of an electronic device interconnection system in accordance with the present invention.
Figure 2:
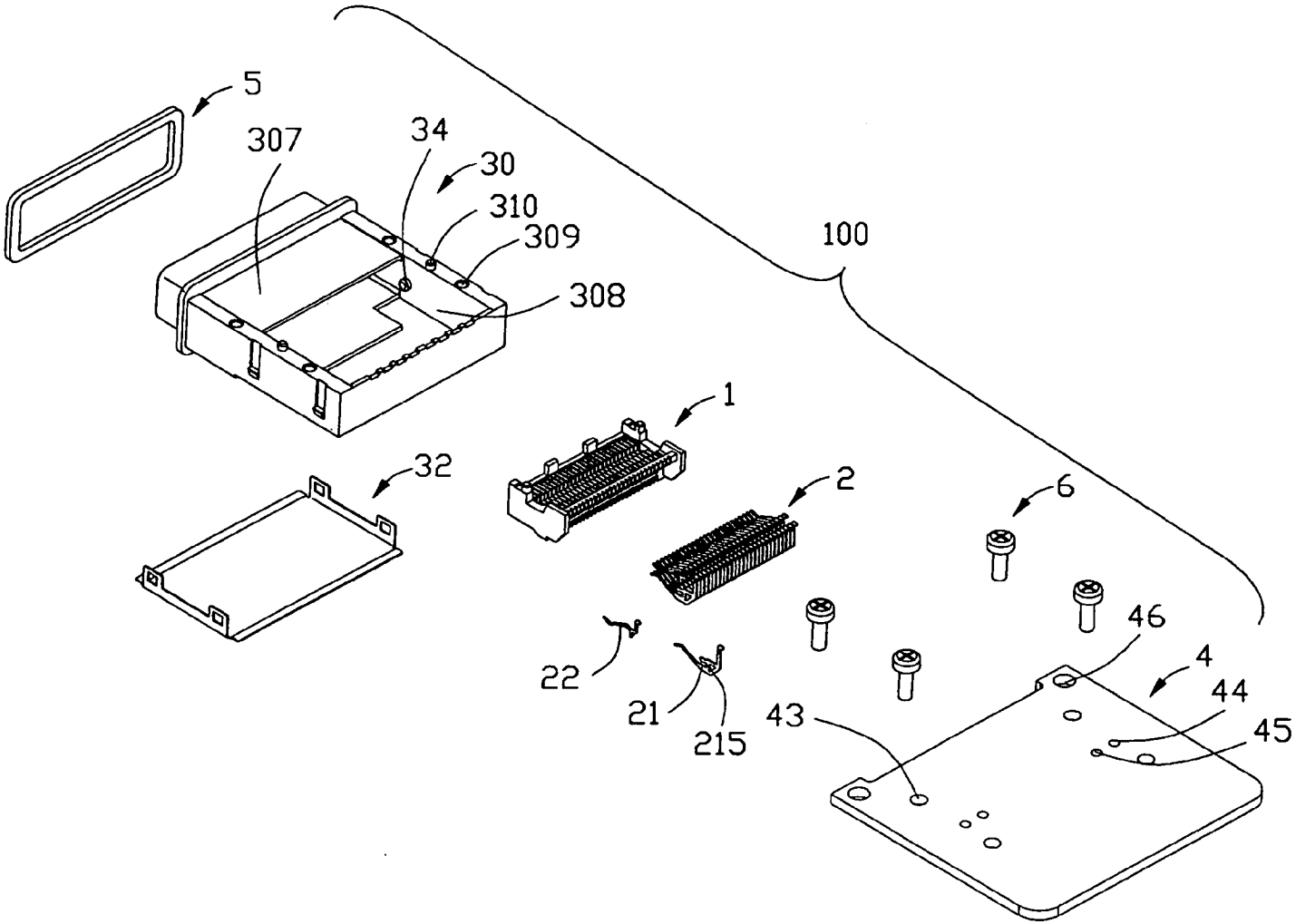
FIG. 2 is a view similar to FIG. 1, but viewed from different angle.
Figure 3:
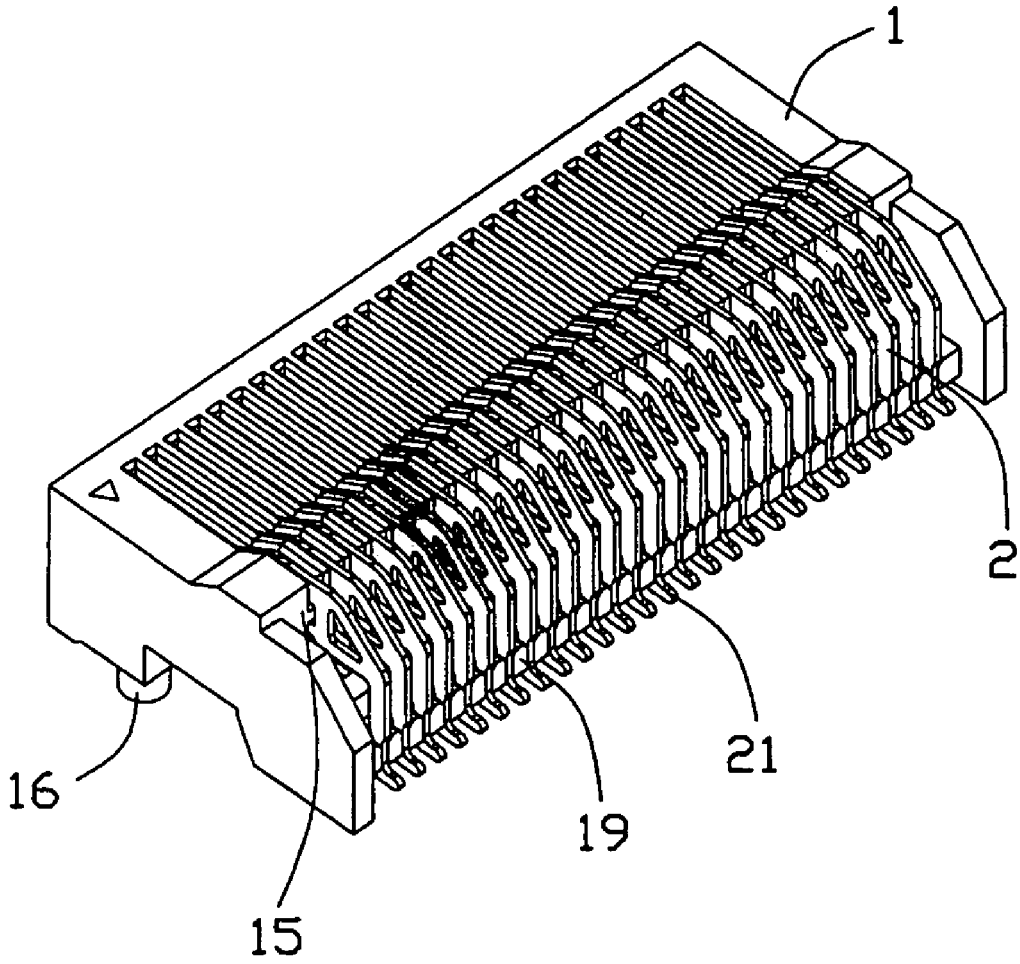
FIG. 3 is a partially assembled view of the receptacle connector.
Figure 4:
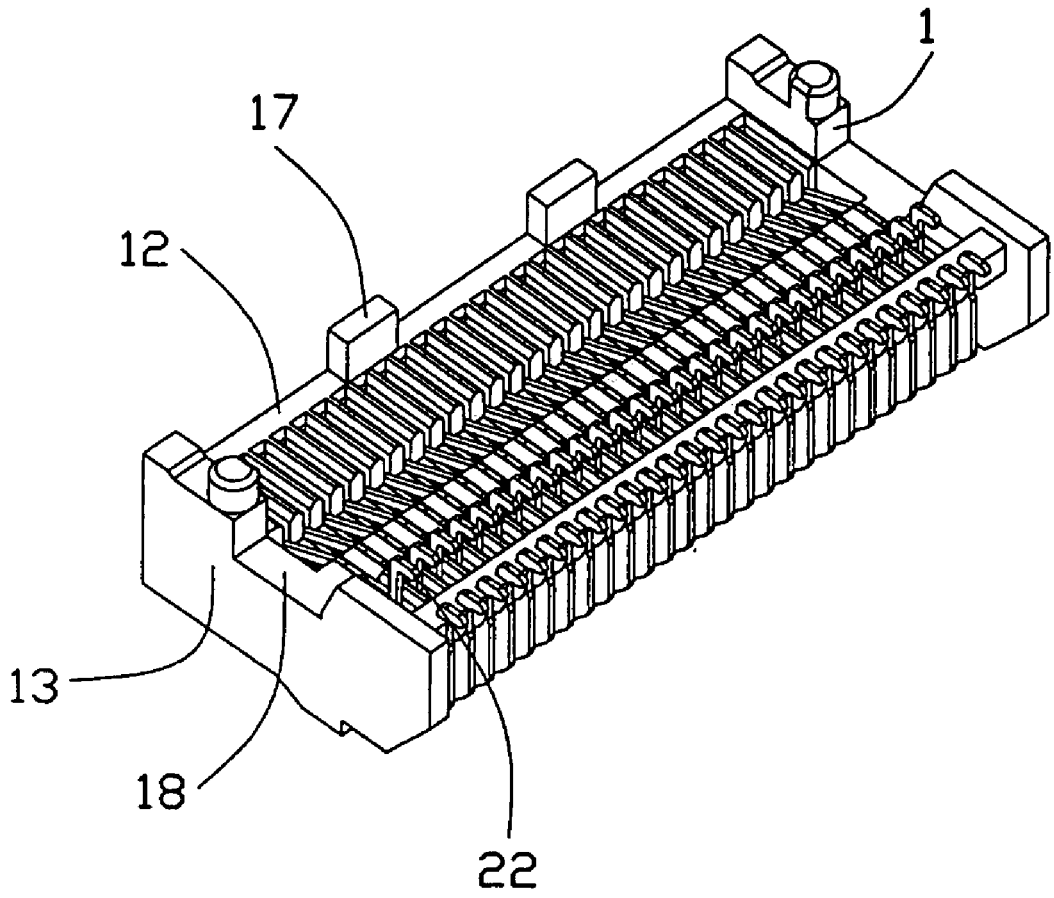
FIG. 4 is a view similar to FIG. 3, but viewed from different angle.
Figure 5:
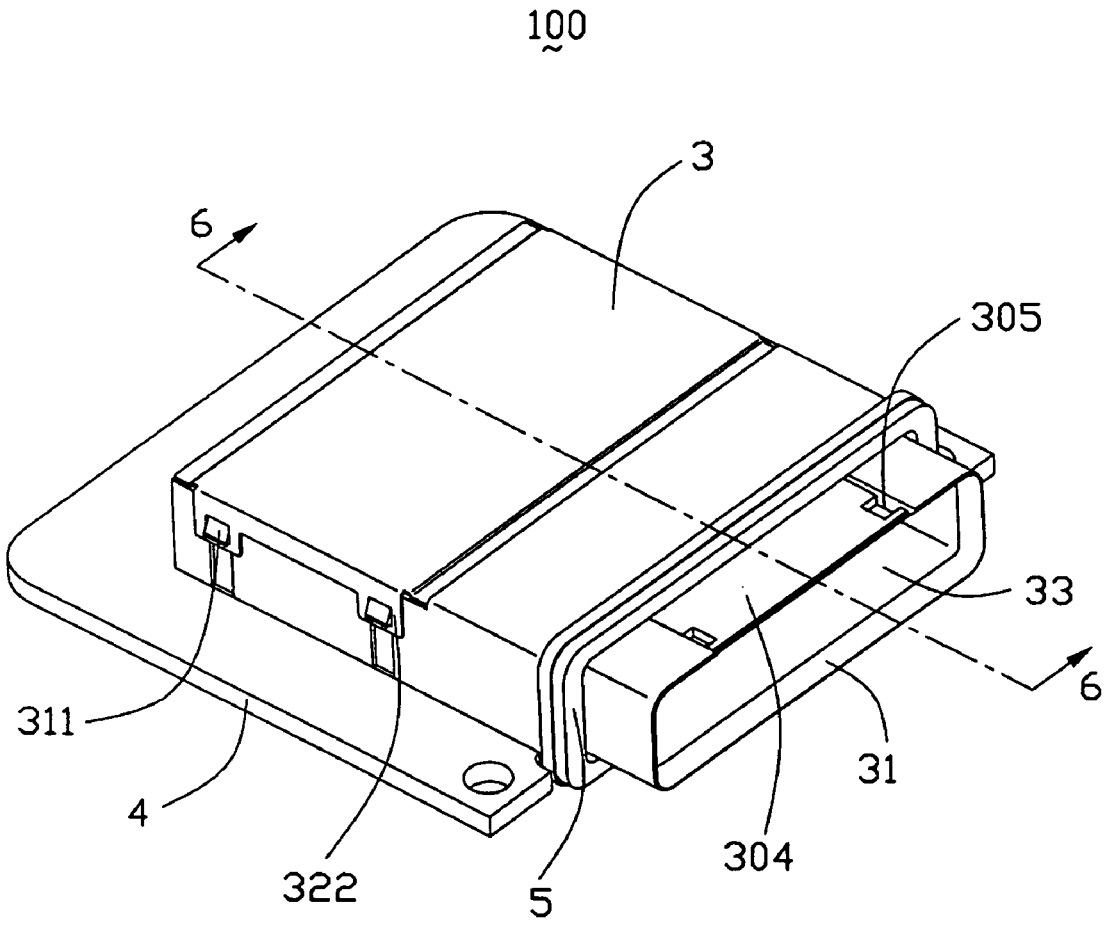
FIG. 5 is an assembled view of the receptacle connector of FIG. 1.
Figure 6:
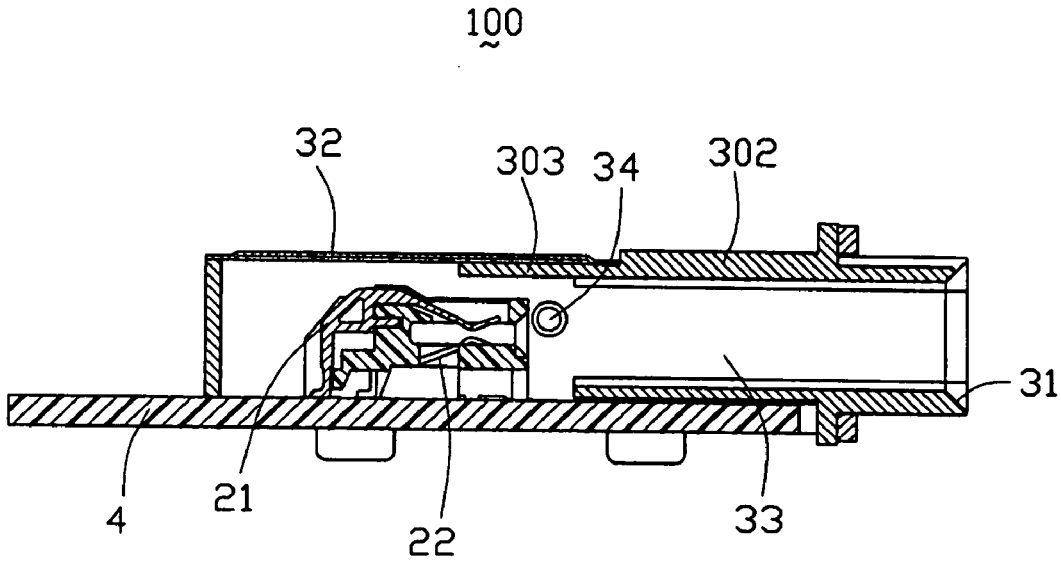
FIG. 6 is a cross-section view taken along line 6—6 of FIG. 5.
Figure 7:
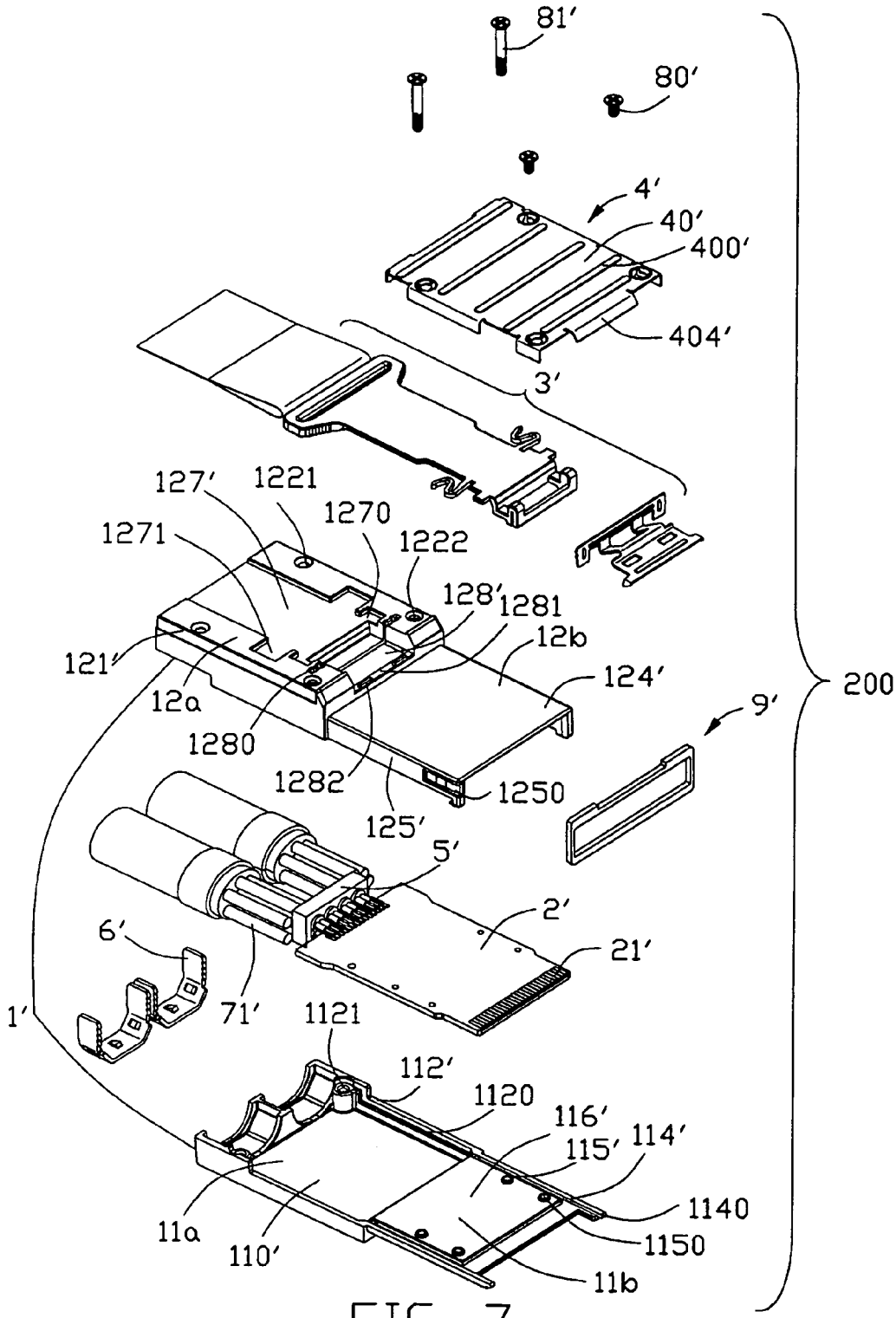
FIG. 7 is an exploded, perspective view of a plug connector of the electronic device interconnection system in accordance with the present invention.
Figure 8:
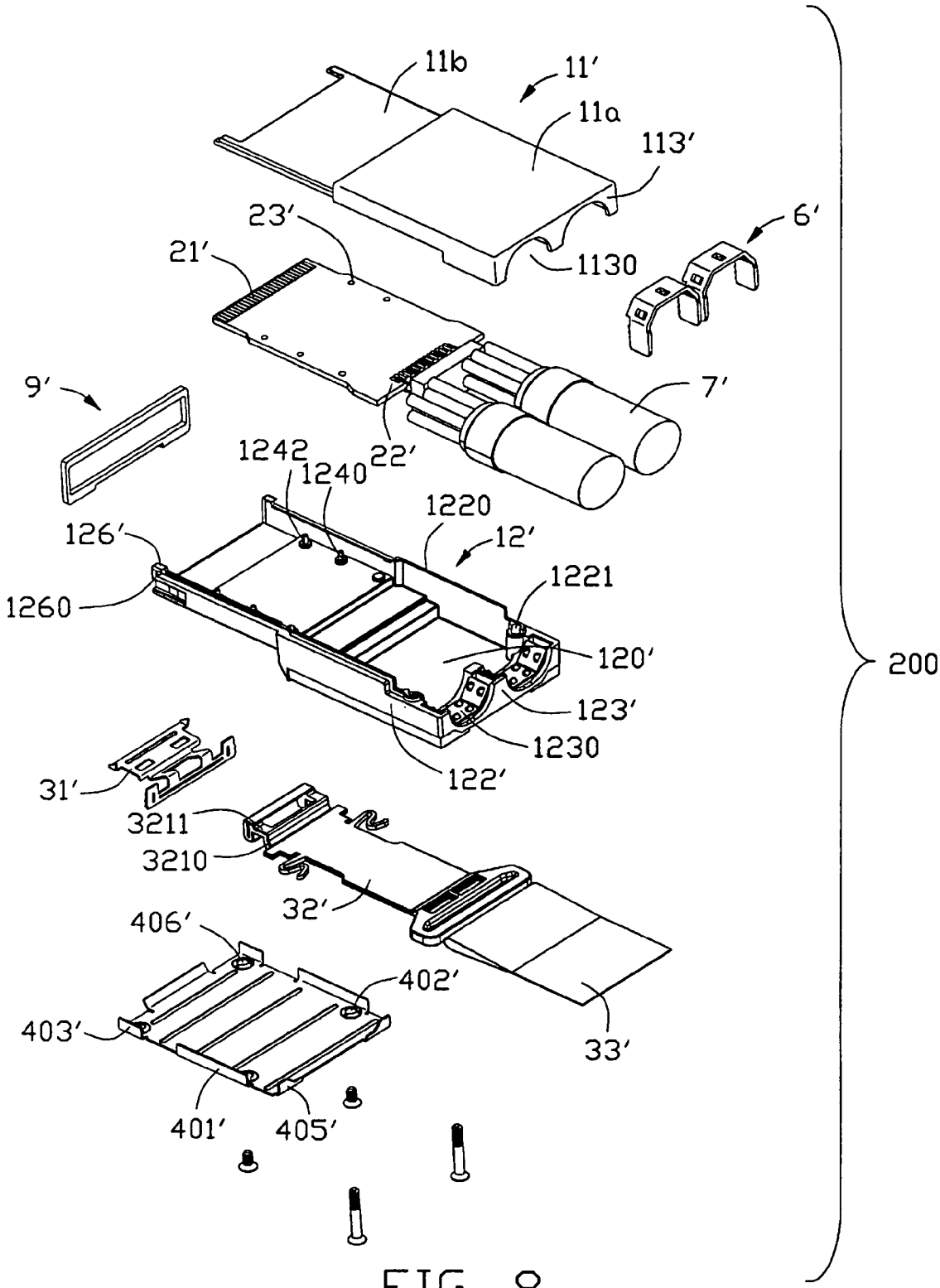
FIG. 8 is a view similar to FIG. 7, but viewed from different angle.
Figure 9:
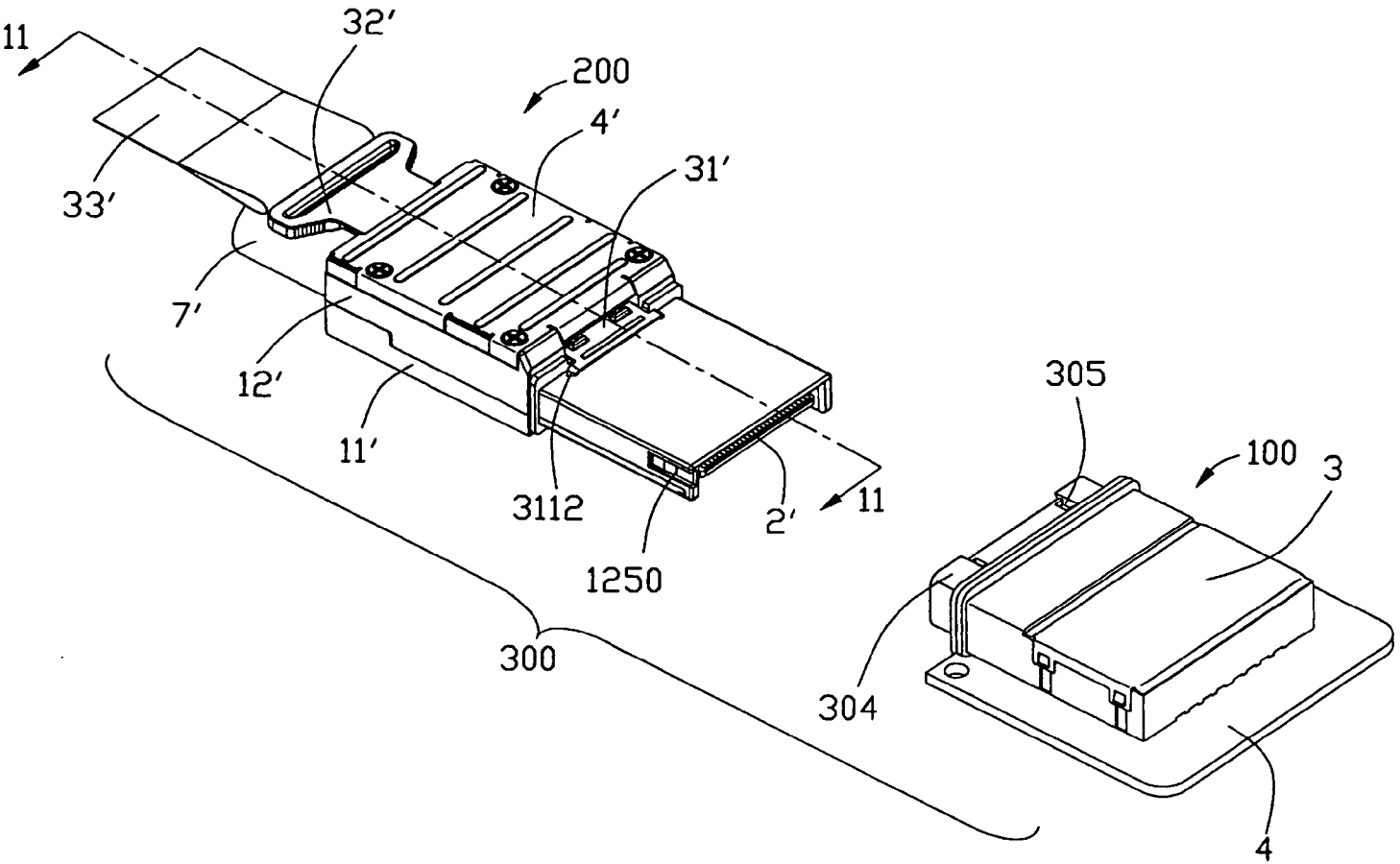
FIG. 9 is an assembled view of the plug connector of FIG. 7 and the assembled view of the receptacle connector of FIG. 1.
Figure 10:
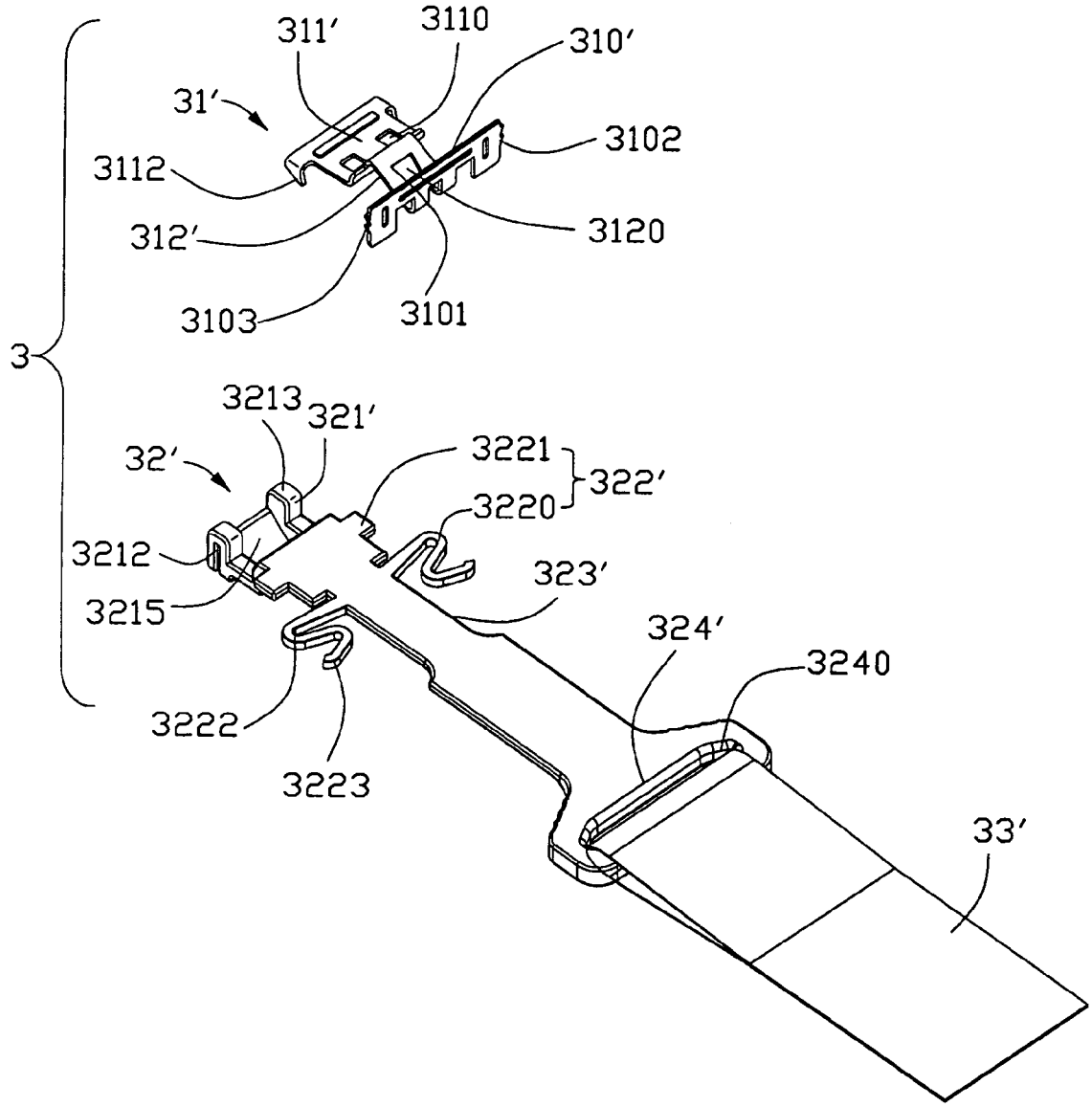
FIG. 10 is an enlarged view of a latch mechanism of FIG. 7.
Figure 11:
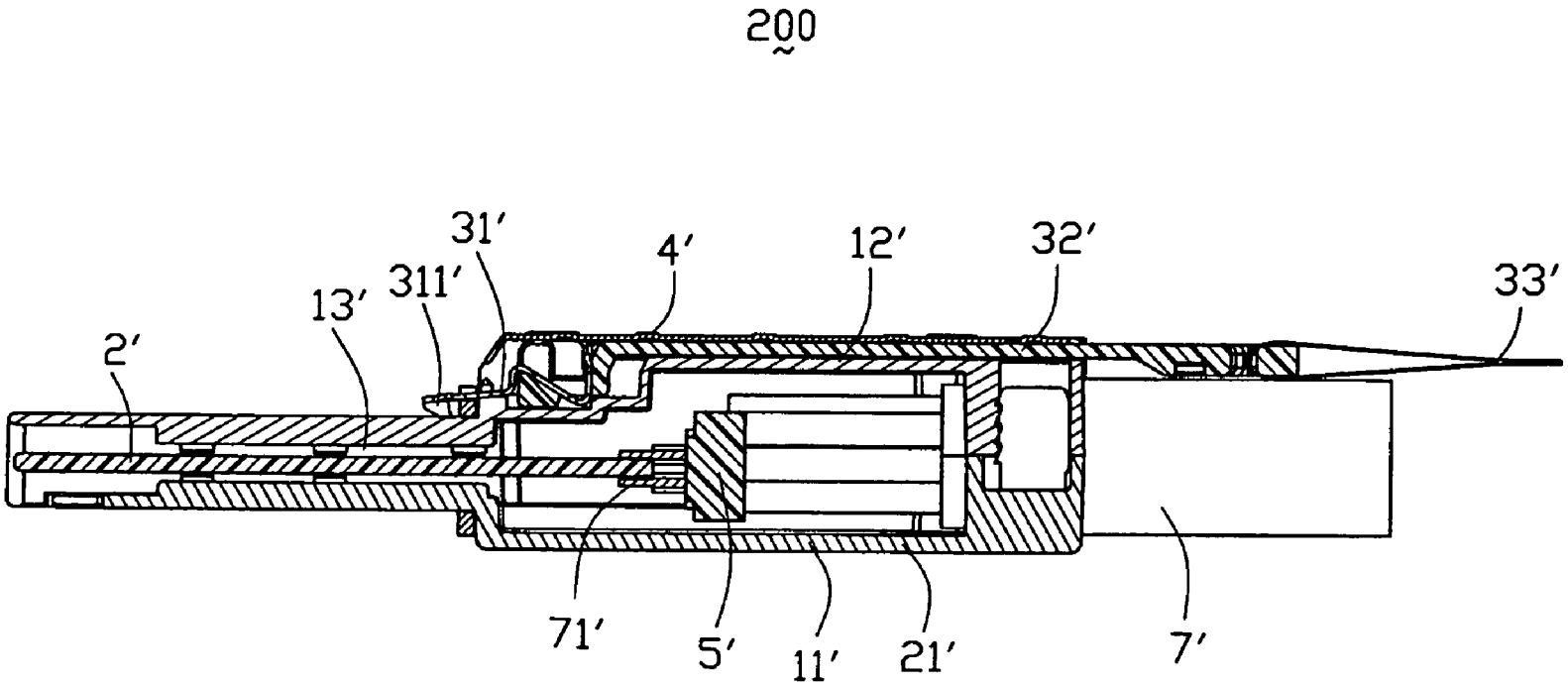
FIG. 11 is a cross-section view taken along line 11—11 of FIG. 9.

Reference will now be made to the drawing figures to describe the present invention in detail.

Figure 12:
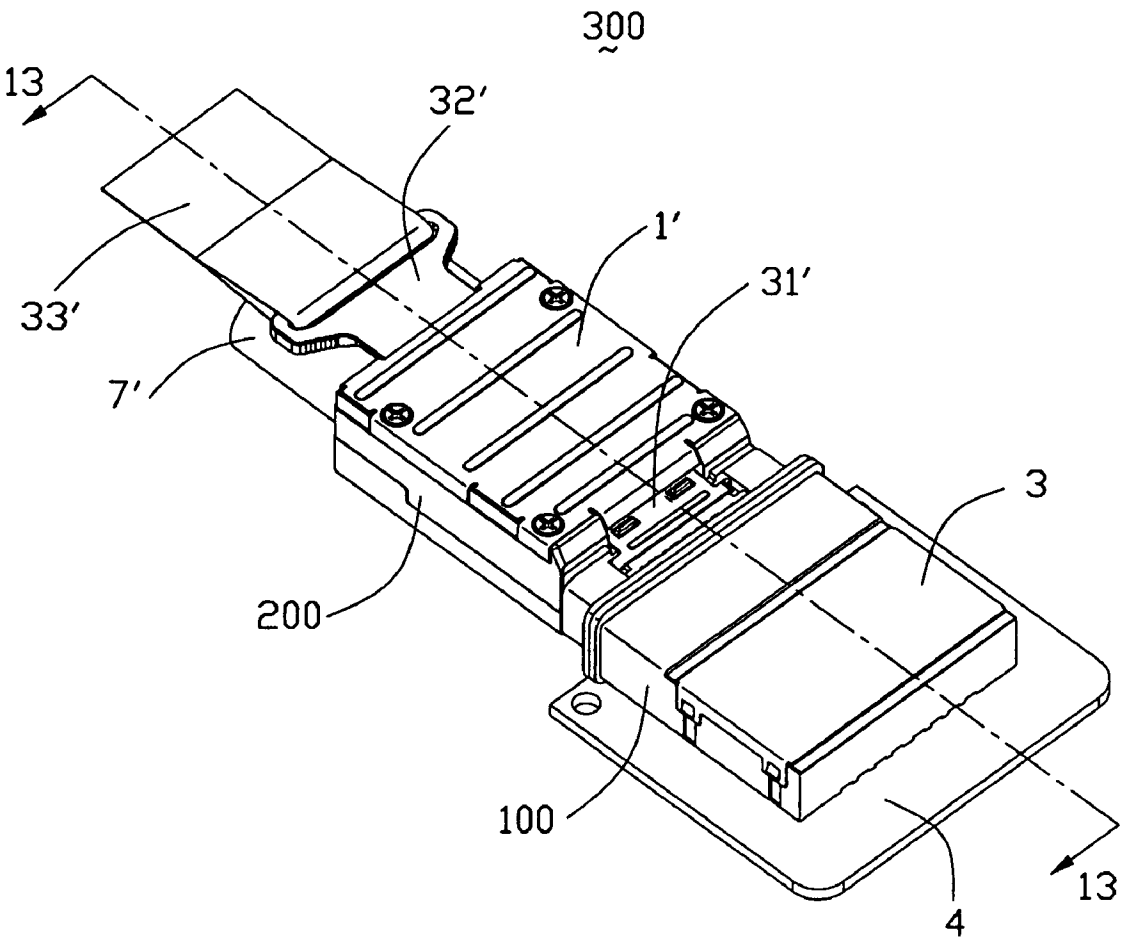
FIG. 12 is an assembled view of the electronic device interconnection system.

Referring to FIG. 12, an electronic device interconnection system 300 comprises a receptacle connector 100 and a plug connector 200 for mating with the receptacle connector 100.

Referring to FIGS. 1–6, the receptacle connector 100 adapted for mounting on a circuit substrate 4 in accordance with the present invention comprises an insulated housing 1, a plurality of terminals 2 received in the insulated housing 1, a metal shell 3 shielding the insulated housing 1.

The insulated housing 1 comprises a top wall 11, a bottom wall 12, a rear wall 15 interconnecting with the top wall 11, the bottom wall 12. The insulated housing 1 further comprises a pair of side walls 13 cooperative with the top wall 11 and the bottom wall 12 to define a receiving passage 14.

A middle portion of each side wall 13 is cut to form an opening 18 recessed upwardly from a bottom thereof and a positioning post 16 adjacent to the opening 18 depends downwardly from the bottom of the side wall 13. A pair of spaced standoffs 17 are formed on the bottom wall 12 and extend downwardly therefrom. The pair of standoffs 17 align with the front surface of the bottom wall 12. A plurality of protrusions 19 extend rearwardly from the lower portion of the rear wall 15.

The terminals 2 are separated into a set of first terminals 21 and another set of second terminals 22 along vertical direction. Each first terminal 21 comprises a contacting portion 211 curved downwardly, a surface-mount type soldering portion 212, and a body portion 214 connecting the contacting portion 211 and the soldering portion 212, a retention portion 213 extending forwardly from the body portion 214 and a vertical beam 215 extending upwardly from middle of the retention portion 213 and connecting with the body portion 214. Each second terminal 22 comprises a contacting portion 221 curved upwardly, a surface-mount type soldering portion 222, a body portion 224 connecting the contacting portion 221 and the soldering portion 222 and a retention portion 223 extending upwardly from relative end of the body portion 224.

The metal shell 3 is a substantially cubic-shape box portion with a front opening 33 and defines a hollow 35 for receiving the insulated housing 1. The metal shell 3 comprises a body portion 30 and a metal board portion 32 assembled to the body portion 30. The front part of the body portion 30 is a loop-guiding portion 304 with a chamfer 31 for mating with the plug connector 200 easily. The body portion 30 comprises a pair of transversal walls 301 interconnecting a top wall 302 and a bottom wall 307. The outer surface of each transversal wall 301 forms a pair of tabs 311 and the inner surface of the left transversal wall 301 forms a projection 34, respectively. In another embodiment (not shown) of the present invention, the projection 34 is formed on the inner surface of the right transversal wall 301. A pair of screw holes 309 recess upwardly from bottom surface of each transversal wall 301 and a cylindrical post 310 locates in middle of the pair of screw holes 309. The rear part of the top wall 302 is partially cut to present a U-shape window 306. A pair of latch holes 305 are defined on the top portion of the loop-guiding portion 304. A planar-guiding portion 303 extends rearward from rear edge of the top wall 302 and extends into the hollow 35. The rear part of the bottom wall 307 is partially cut to form a rectangular opening 308. The hollow 35 communicates with the opening 308 and the window 306. The bottom wall 307 is shorter than the top wall 302 along transversal direction. The metal board portion 32 has a panel portion 321 for covering the window 306 and two pairs of ear parts 322 respectively extending downwardly from two sides of the panel portion 321. Each ear part 322 defines a hole 323 therein for locking with corresponding tab 311 formed on the outer surface of the transversal wall 301. A gasket 5 for suppressing electro magnetic interference (EMI) is assembled to the loop-guiding portion 304.

The circuit substrate 4 comprises a first row of conductive traces 41 and a second row of conductive traces 42 arranged in longitudinal direction respectively, two pair of screw holes 43 divided into two groups and defined in the two sides of the circuit substrate 4, a pair of first holes 44 each defined between the pair of screw holes 43 along transversal direction and a pair of second holes 45 defined between the pair of the first holes 44 along longitudinal direction. The circuit substrate 4 further comprises a pair of fastening holes 46 spaced apart defined in one end thereon for fastening the circuit substrate 4 to an electrical device (not shown).

When assembly, the set of first terminals 21 are assembled to the insulated housing 1 along a front-to-back direction, with the contacting portions 211 exposed in the receiving passage 14, the front part of each retention portion 213 received in the top wall 11, the vertical beams 215 abutting against the rear wall 15, and the soldering portions 212 exposed outwardly and sandwiched between two adjacent protrusions 19, respectively. While, the set of second terminals 22 are assembled to the insulated housing 1 from bottom thereof along a vertical direction perpendicular to the front-to-back direction, with the contacting portions 221 exposed in the receiving passage 14 to face the contacting portions 211 of the set of first terminals 21, the retention portions 223 retained in the bottom wall 12 of the insulated housing 1 and the soldering portions 222 disposed outwardly from the bottom wall 12. Secondly, the insulated housing 1 is mounted to the circuit substrate 4, with the positioning posts 16 received in the second holes 45, the ends of the soldering portions 212, 222 disposed on the first conductive traces 41 and second conductive traces 42 and soldered thereon, respectively. Thirdly, the body portion 30 of the metal shell 3 is mounted to the circuit substrate 4, with the insulated housing 1 inserted into the hollow 35 through the rectangular opening 308, the cylindrical posts 310 protruding into the first holes 44, and the planar-guiding portion 303 located above the insulated housing 1. The body portion 30 is combined with the circuit substrate 4 by screws 6. Fourthly, the metal board portion 32 is assembled to the body portion 30 of the metal shell 3, with the panel portion 321 shielding the window 306 and the holes 323 of the ear portions 322 interferentially locking with the tabs 311 of the transversal wall 32.

Referring to FIGS. 7–11, the plug connector 200 in accordance with the present invention comprises a metal housing 1', a printed circuit board (PCB) 2' retained in the metal housing 1', a pair of cables 7' juxtaposed arranged and electrically connecting with the printed circuit board 2', a latching mechanism 3' assembled to the metal housing 1' and a shielding member 4' assembled to the metal housing 1' and partially covering the latch mechanism 3'.

The metal housing 1' comprises a base 11' and a cover 12' together forming a roomage 13' for receiving the printed circuit board 2'.

The base 11' comprises a first base section 11*a* and a first tongue section 11*b* extending forwardly from the first base section 11*a*. The first base section 11*a* comprises a first flat portion 110', a pair of first flanges 112' and a first rear wall 113' extending upwardly from opposite side edges and rear edge of the first flat portion 110', respectively. The front portions of the first flanges 112' are partially cut to present the first flanges 112' L-shaped. A pair of substantially semicircular first openings 1130 are defined in the first rear wall 113' and a pair of first screw holes 1121 are defined in the first flanges 112' and adjacent to the first rear wall 113'. A first slit 1120 extends downwardly from top surfaces of the first flanges 112'. The first tongue section 11*b* comprises a first panel 116' formed with a pair of ribs 114' located at opposite sides thereof. Each rib 114' forms a tip end 1140 extending beyond a front edge of the first panel 116'. The first panel 116' also forms two pairs of first standoffs 115' spaced arranged thereon, and each first standoff 115' defines a first positioning hole 1150 thereon.

The cover 12' comprises a second base section 12*a* and a second tongue section 12*b* extending forwardly from the second base section 12*a*. The second base section 12*a* comprises a second flat portion 120', a pair of second flanges 122' and a second rear wall 123' extending downwardly from opposite side edges and a rear edge of the second flat portion 120'. The rear portions of the second flanges 122' and the second rear wall 123' are partially cut to present the second flanges 122' L-shaped. A pair of substantially semicircular second openings 1230 are defined in the second rear wall 123'. A pair of second screw holes 1221 are defined in the second flanges 122' and adjacent to the second rear wall 123'. Another pair of third screw holes 1222 are defined in the front section of the second flat portion 120'. Corresponding to the first slit 1120 of the base 11', a continuous protruding ridge 1220 integrally extends downwardly from inner edges of the second flanges 122'. The second flat portion 120' defines a first recess section 127' and a deeper and narrower second recess section 128'. The first recess section 127' comprises different-size first and second recesses 1270, 1271. The second recess section 128' formed in a front portion of the second flat portion 120' communicates with a front surface of the second flat portion 120'. A deeper slit 1280 is defined in the front portion of the second flat portion 120' and extends in a direction perpendicular to that of the second recess section 128' to communicate with the second recess section 128'. A transversely-extending bar 1281 is formed at a front end of the second recess section 128' with a pair of projections 1282 arranged thereon. A pair of channels 121' are respectively defined in opposite sides of the second flat portion 120' extending in a back-to-front direction.

The second tongue section 12*b* comprises a second panel 124' and a pair of side walls 125' extending downwardly from opposite sides of the second panel 124'. A keyway 1250 is defined in corresponding right side wall 125' opened toward outside and matches with the projection 324 of the receptacle connector 100 adapted for anti-mismating. In another embodiment (not shown) of the present invention, the keyway 1250 is defined in the corresponding left side wall 125'. A pair of protrusions 126' extend rearwardly from a front surface of the second tongue section 12*b* and respectively locate below the side walls 125' to form a pair of gaps 1260 therebetween. Two pairs of second standoffs 1240 with positioning posts 1242 thereon are symmetrically arranged on the second panel 124' and extending downwardly therefrom. The first standoffs 115' with the positioning holes 1150 and the second standoffs 1242 positioning posts 1240 are served as first engaging means of the housing 1. The first engaging means is not limited to the structures described above, it also can be protrusions protruding from the first and second tongue sections 11*b*, 12*b*, or recesses recessed from the first and second tongue sections 11*b*, 12*b*.

The PCB 2' is formed with a plurality of first conductive pads 21' aligned at a front end thereof and a plurality of second conductive pads 22' aligned at an opposite rear end thereof. The first and second conductive pads 21', 22' electrically connect with one another through inner traces disposed in the PCB 2'. Two pairs of holes 23' are symmetrically arranged on the PCB 2' adjacent to the first conductive pads 21'. The holes 23' are served as second engaging means of the PCB 2'. The second engaging means is also not limited to the structures described above, it can be standoffs with holes to receive the respective protrusions of the first engaging means of the metal housing 1', or different-shape projections formed on opposite surfaces of the PCB 2' to be received in the recesses of the first engaging means of the metal housing 1'.

The latch mechanism 3' comprises a latch member 31' latching with the receptacle connector 100, a pull member 32' cooperating with the latch member 31' to actuate the latch member 31' to unlatch from the receptacle connector 100 and a pull tape 33' assembled to the pull member 32'.

The latch member 31' is made of metal material and is a cantilever-type member. The latch member 31' comprises an N-shape engaging portion 310' located in a vertical surface, a flat latching portion 311' located in a horizontal surface perpendicular to the vertical surface and an inclined connecting portion 312' connecting the engaging portion 310' with the latching portion 311' to provide spring force to the latch member 31'. The engaging portion 310' comprises a transverse bar section 3101 and a pair of side sections 3102 extending downwardly from opposite sides of the bar section 3101. Each side section 3102 is formed with barbs 3103 on outmost edge thereof. The flat latching portion 311' defines a pair of rectangular holes 3110 at a rear portion thereof adjacent to the connecting portion 312' and a pair of latches 3112 bending downwardly from opposite sides of the front edge thereof. The connecting portion 312' connects with middle portion of the bar section 3101 and extends upwardly from a lower edge of the bar section 3101. The connecting portion 312' also defines a hole 3120 therein for adjusting spring force of the latch member 31' by changing size and shape of the hole 3120.

The pull member 32' is made by insulative material. The pull member 32' is stiff and comprises a cooperating portion 321', an elongated intermediate portion 323' extending rearwardly form the cooperating portion 321' and forming with an interference portion 322', and a substantially rectangular-shape operating portion 324' formed at a rear end of the intermediate portion 323'. The interference portion 322' comprises a pair of stop sections 3221 formed at opposite sides of the intermediate portion 323' and located adjacent to the cooperating portion 321' and a pair of elastic sections 3220 located adjacent to the stop sections 3221. Each elastic section 3220 comprises a transverse block section 3222 and a V-shape claw section 3223 extending rearwardly from the transversal block section 3222. The cooperating portion 321' comprises a vertical section 3210 connecting the cooperating portion 321' with the intermediate portion 323' and a body section 3211 extending forwardly from a lower edge of the vertical section 3210. The body section 3211 forms a pair of upwardly extending ribs 3212 with tip end formed with enlarged protrusions 3213. A slanted surface 3215 downwardly and rearward extends from a front surface of the body section 3211. The flexible pull tape 33' is tied to a slot 3240 defined in the operating portion 324' and is wholly exposed beyond the metal 1' housing of the plug connector 200.

The shielding member 4' comprises a body portion 40' formed with a plurality of bars 400' on a top surface for increasing friction, a pair of first lateral walls 401' and a pair of second lateral walls 403' extending downwardly from opposite sides of the body portion 40'. A pair of first through holes 402' and another pair of second through holes 406' are respectively defined in the rear portion and the front portion of the body portion 40'. A slant first tab 404' and a pair of second tabs 405' respectively extend downwardly from a front edge and a rear edge of the body portion 40'.

In assembly, conductors 71' of the cables 7' are aligned by a wire spacer 5', then the conductors 70 are soldered to the second conductive pads 22' of the PCB 2'. The PCB 2' with the juxtaposed arranged cables 7' are located on the second standoffs 1240 of the cover 12' with the positioning posts 1242 protruding through the holes 23' of the PCB 2' and the cables 7' located in the second semicircular openings 1230 of the cover 12'. The plug connector 200 of the present invention may have cable holders 6' grasping metal braiding areas exposed outside of the cables 7' to provide strain relief to the cables 7'. The base 11' is assembled to the cover 12' with the positioning holes 1150 aligning with the positioning posts 1242 and combining together to position the PCB 2' in the roomage 13' of the metal housing 1'. The PCB 2' is sandwiched between the base 11' and the cover 12' by the first and the second engaging means engaging with each other. The protruding ridge 1220 of the cover 12' is received in the first slit 1120 of the base 11' and the pair of tip ends 1140 are received in the gaps 1260, thus, the base 11' and the cover 12' are also securely assembled together, with the first screw holes 1121 aligning with the second screw holes 1221, and the cables 7' extending outwardly through circular openings formed by the substantially semicircular first openings 1130 and the substantially semicircular second openings 1230. A gasket 9' is assembled to the first, second tongue sections 11*b*, 12*b* and adjacent to the front surface of the first, second flat portions 110', 120'. The gasket 9' is used for suppressing EMI.

The latch mechanism 3' is assembled to the second base section 12*a* of the cover 12' along a vertical direction perpendicular to the front-to-back direction. The pull member 32' is firstly pressed to the cover 12'. The cooperating portion 321' of the pull member 32' is received in the second recess section 128' of the cover 12', and the intermediate portion 323' with the interference portion 322' are received in the first recess section 127'. The stop sections 3221 and the elastic sections 3220 are respectively slidably received in the different-size first and second recesses 1270, 1271 with the block sections 3222 and the claw section 3223 respectively abutting against opposite edges of the large-size second recesses 1271. The latch member 31' is assembled to the cover 12' along the vertical direction and the engaging portion 310' is interferentially received in the slit 1280. The inclined connecting portion 312' is located on the slanted surface 3215 of the body section 3211 of the cooperating portion 321'. The bar section 3101 of the latch member 31' is located on the ribs 3212 with the enlarged protrusions 3213 located in front of the bar section 3101. The projections 1282 of the cover 12' are respectively received in the rectangular holes 3110 and the latches 3112 exposed above the second tongue section 12*b*.

The shielding member 4' is assembled to the second base section 12*a* of the cover 12' with the lateral walls 401', 403' slidably received in the channels 121' of the cover 12' along a back-to-front direction. The slant first tab 404' is received in the second recess section 128' of the cover 12' and the second tabs 405' respectively locate on steps formed on rear edge of the cover 12'. The first tab 404' locates above the latch member 31' to provide extra return force to the latch portion 311' of the latch member 31' when disengaging the plug connector 200 from the receptacle connector 100. A pair of second screws 80' are screwed through the holes 402' of the shielding member 4', the second screw holes 1221 of the cover 12' and the first screw holes 1121 of the base 11' to retain the shielding member 4' with the base 11' and the cover 12'. A pair of second screws 81' are screwed through the holes 406' of the shielding member 4' and the third screw holes 1222 to enhance the combination between the shielding member 4' and the housing 1'.

Figure 13:
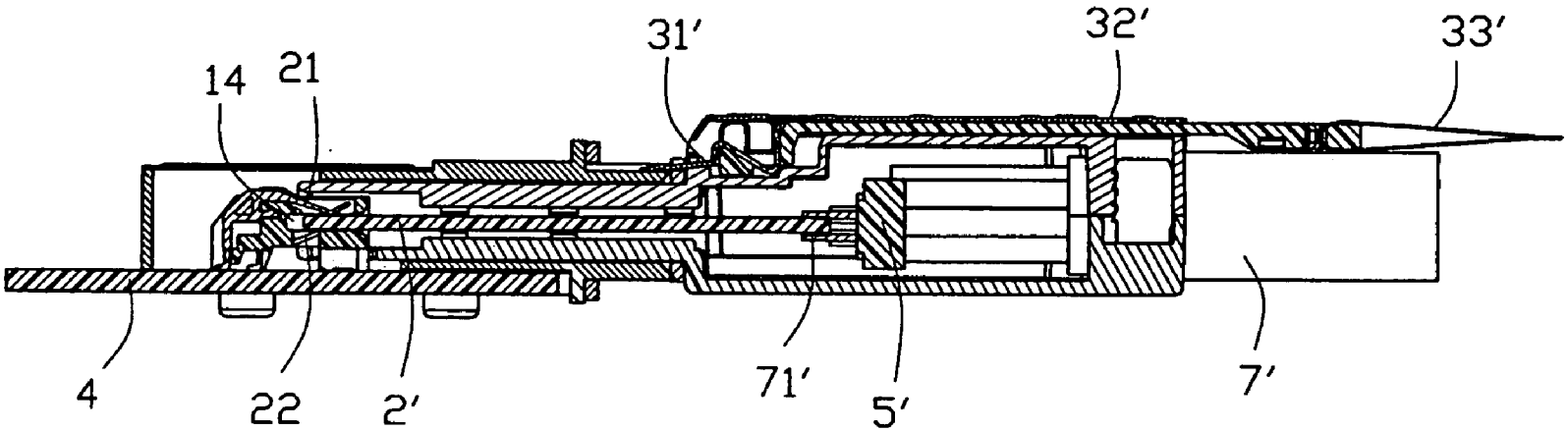
FIG. 13 is cross-section view taken along line 13—13 of FIG. 12.

Referring to FIGS. 12–13 and in conjunction with FIGS. 1–11, when the receptacle connector 100 mating with the plug connector 200, with the leading of the chamfer 31, the first and the second tongue sections 11*b*, 12*b* of the plug connector 200 are inserted into the front opening 33 of the loop-guiding portion 304 easily, then the first and the second tongue sections 11*b*, 12*b* enter the interior of the loop-guiding portion 304 and slides along mating direction, and then the projection 324 of the receptacle connector 100 matches with the keyway 1250 of the plug connector to avoid blind-mating, lastly the planar-guiding portion 303 presses on the top surface of the second tongue portion 12*b* to prevent the first and the second tongue sections 11*b*, 12*b* of the plug connector 200 from rotating upward, and with the guiding of the planar-guiding portion 303, the receptacle connector 100 and the plug connector 200 mate with each other correctly. The contacts 2 of the receptacle connector 100 electrically connect with the first conductive pads 21' of the PCB 2' and the latch holes 305 of the receptacle connector 100 latch with the latches 3112 of the plug connector 200. The gasket 9' abuts with the gasket 5 for suppressing EMI. Thus, the receptacle connector 100 and the plug connector 200 mate reliably. When the plug connector 200 disengages from the receptacle connector 100, a rearward pull force exerts to the pull tape 33' or the pull member 32' (according to the space left for operator) to actuate the pull member 32' to rearwardly move with the elastic sections 3220 and the stop sections 3221 sliding in the first and second recesses 1271, 1270 until the enlarged protrusions 3213 abut against the bar section 3101 of the latch member 31'. The body section 3211 also rearwardly moves with the slanted surface 3215 sliding along a bottom periphery of the inclined connecting portion 312', thus actuating the connecting portion 312' to pivot upwardly relative to the bar section 3101 of the engaging portion 310' and the latch section 311' with the latches 3112 to upwardly move to unlatch from the receptacle connector 100. After the rearward pull force is removed, restore force of the elastic sections 3220 actuates the pull member 32' to move forwardly to its original position. The slant first tab 404' of the shielding member 4' provides a restore force for the latch member 31' and the latch member 31' reverts to its original position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic device interconnection system, comprising:

a plug connector comprising:

a metal housing defining a roomage;

a printed circuit board received in the roomage;

at least one cable electrically connecting with the printed circuit board;

a latch mechanism comprising a latch member assembled to the metal housing, the latch member comprising an engaging portion engaging with the metal housing and a latch portion extending forwardly from the engaging portion; and a receptacle connector mating with the plug connector, comprising:

an insulated housing defining a receiving passage;

a plurality of terminals received in the insulated housing;

a metal shell defining a body portion with a hollow to receive the insulated housing; and the body portion defining at least one latch hole in front portion thereof to receive the latch portion of the latch member; and the body portion further defining a planar-guiding portion extending into the hollow and located above the insulated housing for suppressing rotation of the plug connector and guiding the plug connector inserting into the receptacle connector;

wherein the body portion of the receptacle connector defines a top wall and the planar-guiding portion extends rearward from the rear edge of the top wall;

wherein the body portion comprises a bottom wall defining an opening and the top wall defines a window, and wherein the hollow communicates with the opening and the window, and wherein the bottom wall is shorter than the top wall along transversal direction.

2. The electronic device interconnection system as claimed in claim 1, wherein the metal housing of the plug connector defines a tongue section, and wherein the metal shell defines a loop-guiding portion formed with a chamfer for guiding the tongue section inserting into the hollow of the metal shell.

3. The electronic device interconnection system as claimed in claim 1, wherein the plug connector defines a keyway in either a right side wall or a left side wall, and wherein the receptacle connector defines a projection on either a left transversal wall or a right transversal wall matching with the keyway for anti-mismating.

4. The electronic device interconnection system as claimed in claim 1, wherein the insulated housing of the receptacle connector comprises a pair of spaced standoffs extending downwardly from the bottom thereof and the pair of standoffs align with the front surface of the bottom wall.

5. The electronic device interconnection system as claimed in claim 1, wherein the latch mechanism further comprises a stiff pull member assembled to the metal housing of the plug connector to actuate the latch member disengaging from the receptacle connector.

6. The electronic device interconnection system as claimed in claim 1, wherein the latch mechanism further comprises a soft pull tape wholly exposed beyond the metal housing of the plug connector to actuate the pull member rearwardly moving.

7. The electronic device interconnection system as claimed in claim 1, wherein the metal shell further comprises a metal board portion assembled to the body portion for shielding the window.

8. The electronic device interconnection system as claimed in claim 7, wherein the body portion has a pair of transversal walls each forming at least one tab and the metal board portion has at least one ear portion, and wherein the ear portion defines a hole locking with the corresponding tab.

9. The electronic device interconnection system as claimed in claim 1, wherein the metal housing of the plug connector comprises a base and a cover together forming the roomage for receiving the printed circuit board.

10. The electronic device interconnection system as claimed in claim 9, wherein the base and the cover are combined together by screws.

11. The electronic device interconnection system as claimed in claim 1, wherein the plug connector further comprises a shielding member assembled to the metal housing and partially covering the latch mechanism.

12. The electronic device interconnection system as claimed in claim 11, wherein the shielding member comprises a first tab extend downwardly from front edge thereof and the first tab provides a restore force for the latch member.

13. The electronic device interconnection system as claimed in claim 1, wherein the terminals of the receptacle connector are separated into a set of first terminals and a set of second terminals arranged in vertical direction.

14. The electronic device interconnection system as claimed in claim 13, wherein the set of the first terminals are assembled to the insulated housing along front-to-back direction and the set of second terminals are assembled to the insulated housing along vertical direction.

15. The electronic device interconnection system as claimed in claim 13, wherein each of the first terminals and the second terminals has corresponding body portion and retention portion, and wherein the retention portion of the first terminal extends forwardly from the body portion and the retention portion of the second terminal extends from the body portion upwardly.

16. The electronic device interconnection system as claimed in claim 15, wherein the first terminal further comprises a beam extending form the retention portion and connecting with the body portion.

17. An electrical connector assembly comprising:

a plug connector comprising:

a metal housing defining a roomage;

a printed circuit board received in the roomage;

at least one cable electrically connecting with the printed circuit board;

a latch mechanism comprising a latch member assembled to the metal housing, the latch member comprising an engaging portion engaging with the metal housing and a latch portion extending forwardly from the engaging portion; and a receptacle connector mating with the plug connector, comprising:

an insulated housing defining a receiving passage;

a plurality of terminals received in the insulated housing;

a printed circuit board defining opposite upper and bottom surfaces thereon; an electrical connector mounted on the upper surface and away from an edge of said printed circuit board;

a metallic shell having a main body with a hollow to receive the insulated housing and to define a mating frame in communication with an exterior in a front-to-back direction in a front portion, a bottom opening dimensioned large enough to allow the connector to extend therethrough, a top opening covered by a detachable metal board portion; and said body portion defining at least one latch hole in front portion thereof to receive the latch portion of the latch member;

the body portion further defining a planar-guiding portion extending into the hollow and located above the insulated housing for suppressing rotation of the plug connector and guiding the plug connector inserting into the receptacle connector;

wherein the body portion of the receptacle connector defines a top wall and the planar-guiding portion extends rearward from the rear edge of the top wall;

wherein the body portion comprises a bottom wall defining an opening and the top wall defines a window, and wherein the hollow communicates with the opening and the window, and wherein the bottom wall is shorter than the top wall along transversal direction.

18. The assembly as claimed in claim 17, wherein the guiding plate portion is formed in the top opening which overlaps with the detachable metal board portion.

* * * * *